US010770820B2

(12) United States Patent
Huang et al.

(10) Patent No.: US 10,770,820 B2
(45) Date of Patent: Sep. 8, 2020

(54) CONDUCTIVE TERMINAL AND CONNECTOR

(71) Applicants: Tyco Electronics (Shanghai) Co. Ltd., Shanghai (CN); TE Connectivity India Private Limited, Bangalore (IN)

(72) Inventors: Yongjian Huang, Shanghai (CN); Tongbao Ding, Shanghai (CN); Sheng Li, Shanghai (CN); P.K. Senthil Kumar, Bangalore (IN)

(73) Assignees: Tyco Electronics (Shanghai) Co. Ltd., Shanghai (CN); TE Connectivity India Private Limited, Bangalore (IN)

( * ) Notice: Subject to any disclaimer, the term of this patent is extended or adjusted under 35 U.S.C. 154(b) by 0 days.

(21) Appl. No.: 16/364,369

(22) Filed: Mar. 26, 2019

(65) Prior Publication Data

US 2019/0296472 A1 Sep. 26, 2019

(30) Foreign Application Priority Data

Mar. 26, 2018 (CN) ..... 2018 1 0252995

(51) Int. Cl.
*H01R 4/242* (2018.01)
*H01R 13/422* (2006.01)
(Continued)

(52) U.S. Cl.
CPC ..... *H01R 13/4223* (2013.01); *H01R 4/242* (2013.01); *H01R 4/48* (2013.01);
(Continued)

(58) Field of Classification Search
CPC ..... H01R 4/242; H01R 4/26; H01R 4/2425; H01R 4/2462; H01R 4/2466
See application file for complete search history.

(56) References Cited

U.S. PATENT DOCUMENTS 3,937,549 A 2/1976 Hughes
4,548,459 A * 10/1985 Mosser, III ..... H01R 4/2462 439/395

(Continued)

FOREIGN PATENT DOCUMENTS

DE 4306795 9/1994
DE 202010008457 U1 1/2012

(Continued)

OTHER PUBLICATIONS

Abstract and machine translation of JP201000923, dated Jan. 7, 2010, 28 pages.

(Continued)

*Primary Examiner* — Tho D Ta
(74) *Attorney, Agent, or Firm* — Barley Snyder

(57) ABSTRACT

A conductive terminal comprises a body and a pair of first elastic cantilevers adapted to clamp a first conductor. The pair of first elastic cantilevers are connected to the body and accommodated within a first accommodation chamber formed in the body. Each first elastic cantilever or the body has a first elastic support structure. A free end of each first elastic cantilever is elastically supported on an inner wall of the first accommodation chamber by the first elastic support structure when the first conductor is clamped between the pair of first elastic cantilevers.

14 Claims, 6 Drawing Sheets

(51) Int. Cl.

| | |
|---|---|
| ***H01R 4/48*** | (2006.01) |
| ***H01R 12/51*** | (2011.01) |
| ***H01R 13/05*** | (2006.01) |
| ***H01R 13/11*** | (2006.01) |
| ***H01R 13/24*** | (2006.01) |
| ***H01R 13/504*** | (2006.01) |
| *H01R 4/2425* | (2018.01) |
| *H01R 4/26* | (2006.01) |
| *H01R 4/2462* | (2018.01) |
| *H01R 4/2466* | (2018.01) |

(52) U.S. Cl.

CPC ..... *H01R 4/4845* (2013.01); *H01R 12/515* (2013.01); *H01R 13/05* (2013.01); *H01R 13/11* (2013.01); *H01R 13/2442* (2013.01); *H01R 13/504* (2013.01); *H01R 4/2425* (2013.01); *H01R 4/2462* (2013.01); *H01R 4/2466* (2013.01); *H01R 4/26* (2013.01)

(56) References Cited

U.S. PATENT DOCUMENTS

| | | | | |
|---|---|---|---|---|
| 4,749,365 | A * | 6/1988 | Magnifico | H01R 4/2425 439/396 |
| 5,827,087 | A | 10/1998 | Yamasaki | |
| 6,908,331 | B2 * | 6/2005 | Brown | H01R 4/242 439/395 |
| 7,644,541 | B2 * | 1/2010 | Piovesan | H01R 4/2425 49/395 |
| 8,105,105 | B2 * | 1/2012 | Taniguchi | H01R 4/2425 439/395 |
| 9,083,091 | B1 * | 7/2015 | Ravlich | H01R 4/2425 |
| 2004/0077208 | A1 | 4/2004 | Brown | |

FOREIGN PATENT DOCUMENTS

| | | | | |
|---|---|---|---|---|
| DE | 202013001330 | U1 | 5/2013 | |
| DE | 202014106002 | U1 | 3/2015 | |
| EP | 0645857 | A1 * | 3/1995 | H01R 43/16 |
| EP | 0788189 | A2 * | 8/1997 | H01R 4/24 |
| EP | 0788189 | A2 | 8/1997 | |
| EP | 1953868 | B1 | 4/2014 | |
| IT | 96PD0012 | | 1/1996 | |
| IT | 2007PD0033 | A1 | 8/2008 | |
| JP | 09232010 | A | 9/1997 | |
| JP | 2010000923 | A | 1/2010 | |

OTHER PUBLICATIONS

Abstract and translation of DE202010008457, dated Jan. 26, 2012, 11 pages.

Abstract and translation of DE202013001330, dated May 16, 2013, 5 pages.

Abstract and translation of DE202014106002, dated Mar. 12, 2015, 9 pages.

Abstract and translation of DE4306795, dated Sep. 8, 1994, 10 pages.

* cited by examiner

CONDUCTIVE TERMINAL AND CONNECTOR

CROSS-REFERENCE TO RELATED APPLICATION

This application claims the benefit of the filing date under 35 U.S.C. § 119(a)-(d) of Chinese Patent Application No. 201810252995.9, filed on Mar. 26, 2018.

FIELD OF THE INVENTION

The present invention relates to a conductive terminal and, more particularly, to a conductive terminal adapted to elastically clamp a conductor.

BACKGROUND

A conductive terminal is adapted to be electrically connected with a conductor in a clamping manner. The conductive terminal typically comprises two pairs of elastic cantilevers, each pair of which are adapted to clamp one conductor, such as a wire.

In order to reliably clamp the conductor, the elastic cantilevers are elastically deformed when the conductor is clamped between the pair of elastic cantilevers. However, when the conductor is clamped between the pair of elastic cantilevers, free ends of the elastic cantilevers are in a suspended state. The elastic cantilevers each are always used as a cantilever beam, which causes the elastic cantilevers to be easily plastically deformed when a diameter of the clamped conductor is excessively large or the conductive terminal vibrates. Once the elastic cantilevers are plastically deformed, an electrical contact between the conductive terminal and the conductor will be unreliable or even ineffective.

SUMMARY

A conductive terminal comprises a body and a pair of first elastic cantilevers adapted to clamp a first conductor. The pair of first elastic cantilevers are connected to the body and accommodated within a first accommodation chamber formed in the body. Each first elastic cantilever or the body has a first elastic support structure. A free end of each first elastic cantilever is elastically supported on an inner wall of the first accommodation chamber by the first elastic support structure when the first conductor is clamped between the pair of first elastic cantilevers.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
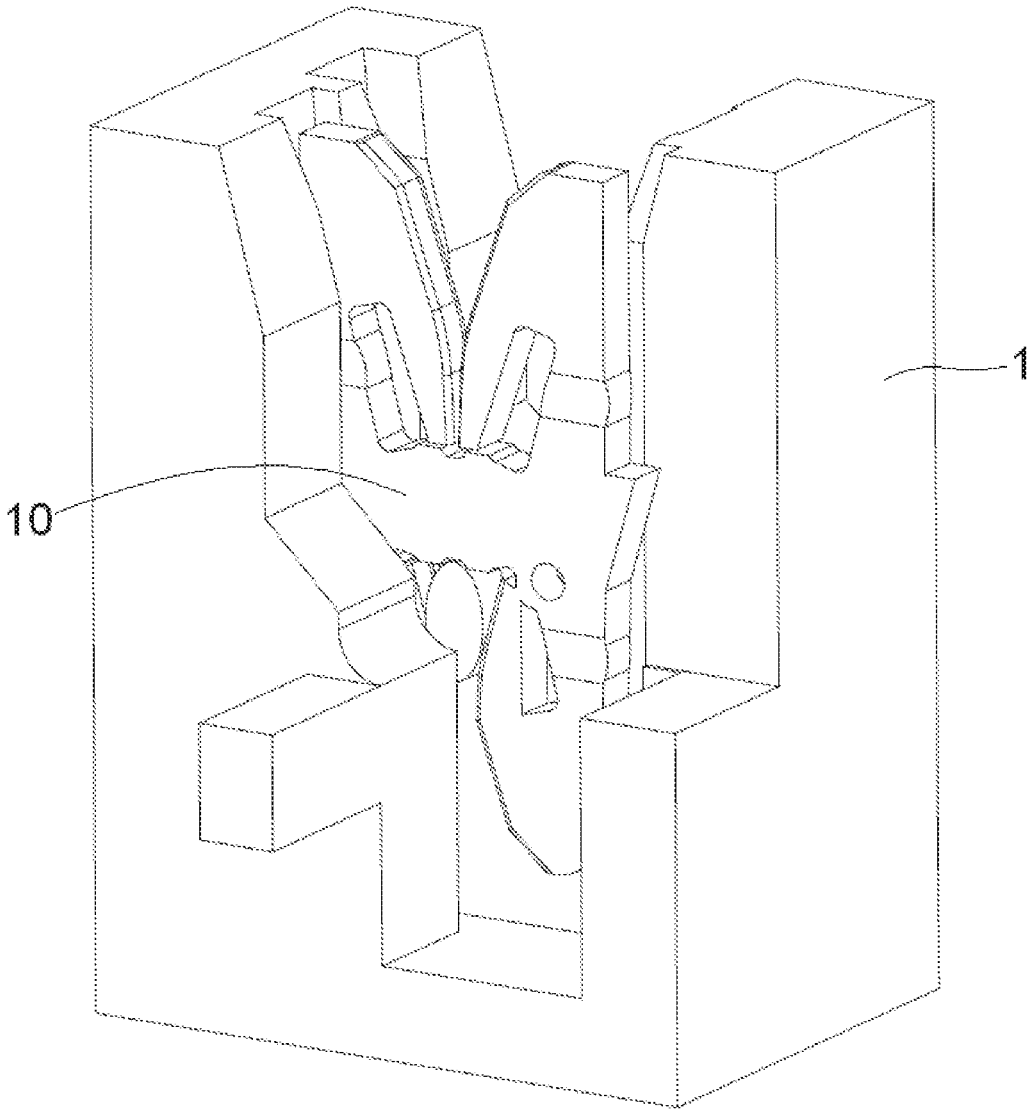
FIG. 1 is a perspective view of a connector according to an embodiment.

The technical solution of the disclosure will be described hereinafter in further detail with reference to the following embodiments, taken in conjunction with the accompanying drawings. In the specification, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

A connector according to an embodiment, as shown in FIG. 1, comprises an insulation body 1 and a conductive terminal 10 accommodated within the insulation body 1.

Figure 2:
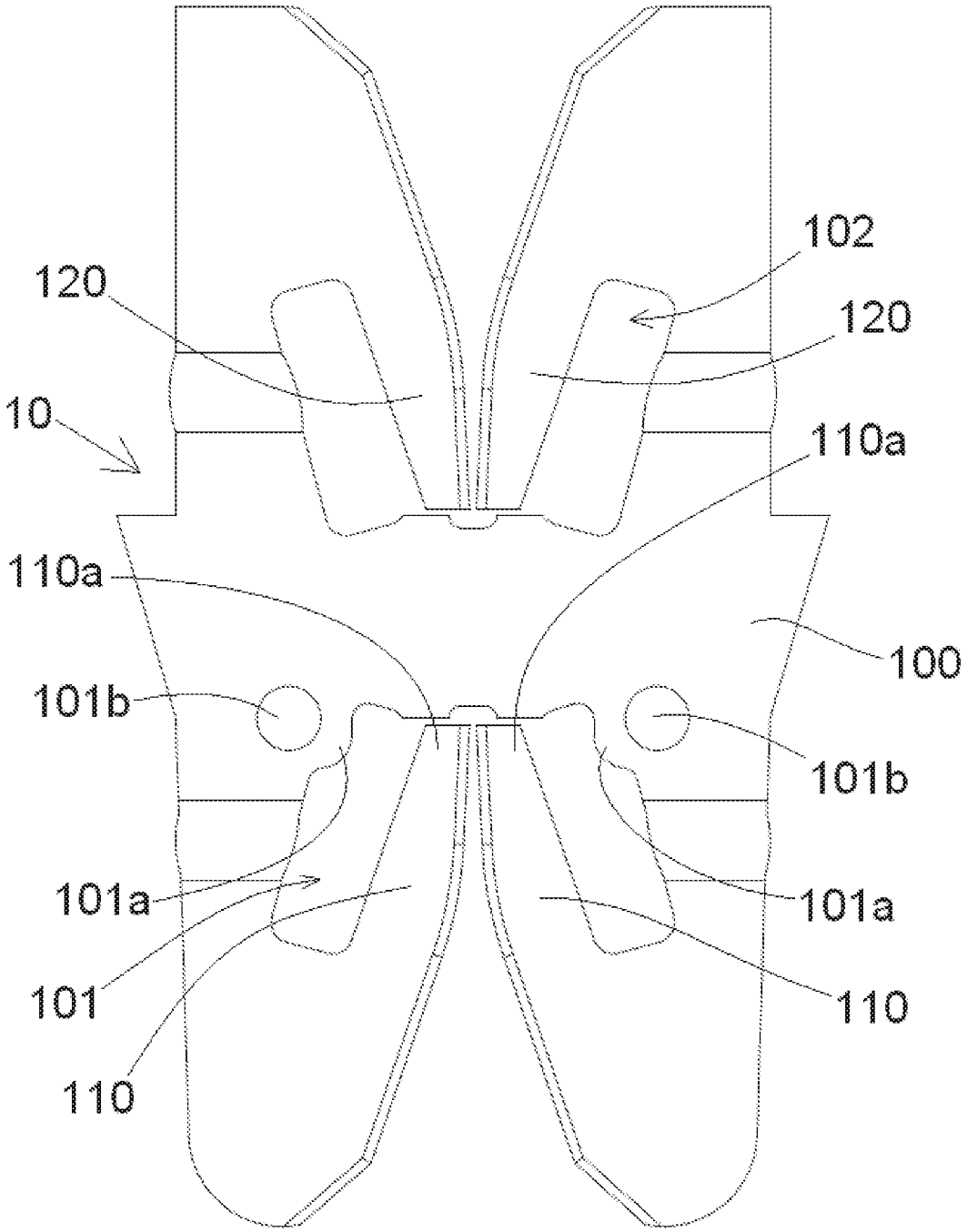
FIG. 2 is a front view of a conductive terminal of the connector of FIG. 1.
Figure 3:
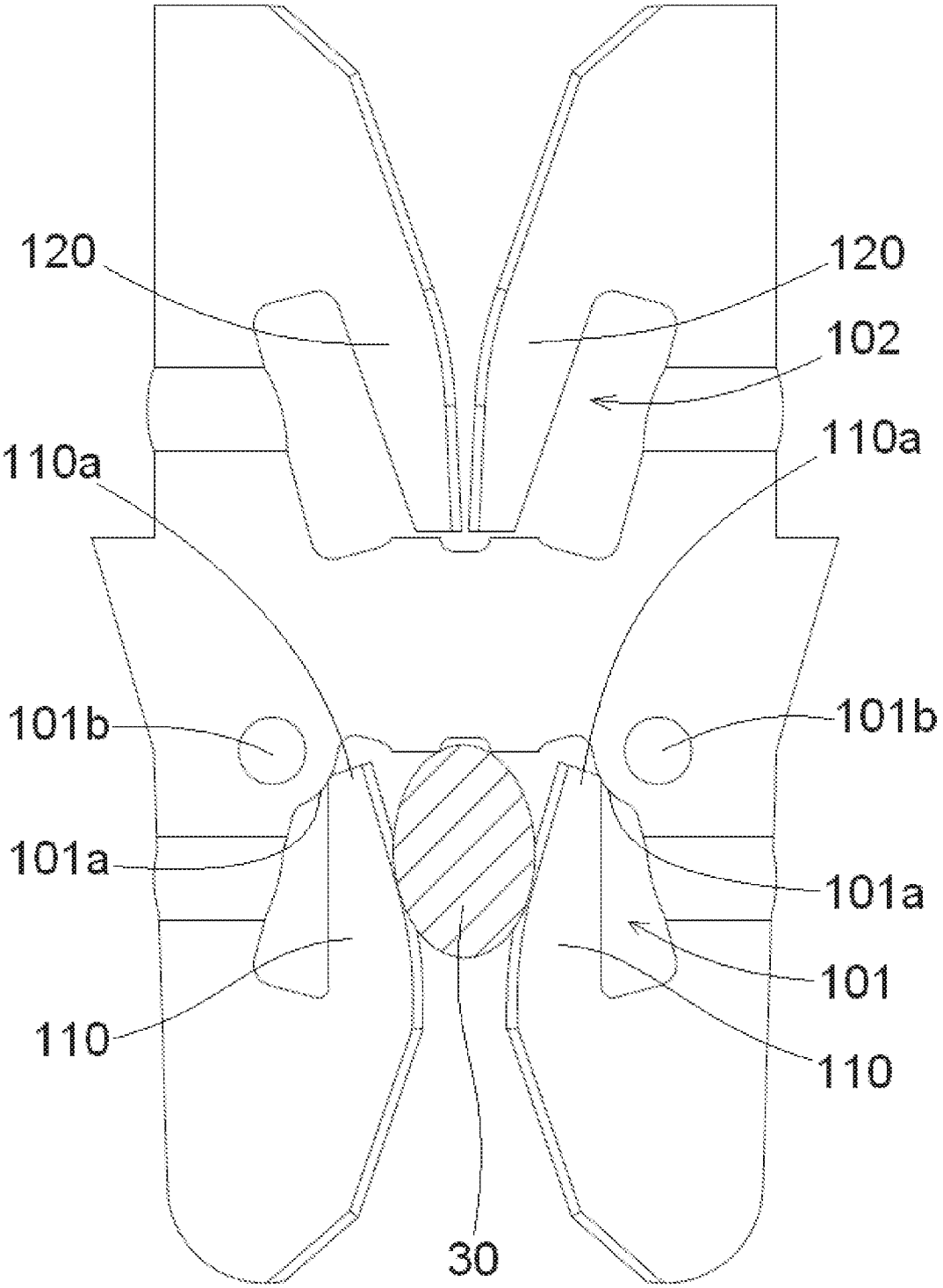
FIG. 3 is a front view of the conductive terminal of FIG. 2 with a first conductor.

As shown in FIGS. 2 and 3, the conductive terminal 10 comprises a body 100 and a pair of first elastic cantilevers 110, 110 adapted to clamp a first conductor 30. The pair of first elastic cantilevers 110, 110 are connected to the body 100 and accommodated within a first accommodation chamber 101 formed in the body 100. In an embodiment, the conductive terminal 10 is a single metal terminal formed by punching a single metal sheet or by a molding process.

Each first elastic cantilever 110, as shown in FIGS. 2 and 3, has a first elastic support structure 101*a*, 101*b*, by which a free end 110*a* of each first elastic cantilever 110 is elastically supported on an inner wall of the first accommodation chamber 101 when the first conductor 30 is pressed and clamped between the pair of first elastic cantilevers 110, 110. The first elastic support structure 101*a*, 101*b* includes a first protrusion 101*a* formed on the inner wall of the first accommodation chamber 101 and a first passageway 101*b* formed in the body 100. The first passageway 101*b* is located adjacent the first protrusion 101*a* so that the first protrusion 101*a* is elastically deformable under compression.

As shown in FIG. 3, the free end 110*a* of each first elastic cantilever 110 is elastically supported on the first protrusion 101*a* when the first conductor 30 is pressed and clamped between the pair of first elastic cantilevers 110, 110. In this way, each first elastic cantilever 110 becomes a simple supported beam structure from a cantilever beam structure, thereby effectively reducing the risk of plastic deformation of the first elastic cantilevers 110, 110.

The conductive terminal 10, as shown in FIGS. 2 and 3, comprises a pair of second elastic cantilevers 120, 120 adapted to clamp a second conductor. The pair of second elastic cantilevers 120, 120 are connected to the body 100 and accommodated within a second accommodation chamber 102 formed in the body 100. In the shown embodiment, the first pair of elastic cantilevers 110, 110 and the pair of second elastic cantilevers 120, 120 are identical to each other and symmetrically arranged on the conductive terminal 10.

In an embodiment, the second conductor may have a diameter less than that of the first conductor 30. Thus, a free end of each second elastic cantilever 120 will not be in contact with an inner wall of the second accommodation chamber 102 when the second conductor is clamped between the pair of elastic cantilevers 120, 120. Therefore, there is no second elastic support structure for elastically supporting the free end of the second elastic cantilevers 120 on the conductive terminal 10. In other embodiments, however, it is possible to provide a second elastic support structure elastically supporting the free end of the second elastic cantilever 120 on the conductive terminal 10. The second elastic support structure may be similar or identical to the first elastic support structure 101*a*, 101*b*.

Figure 4:
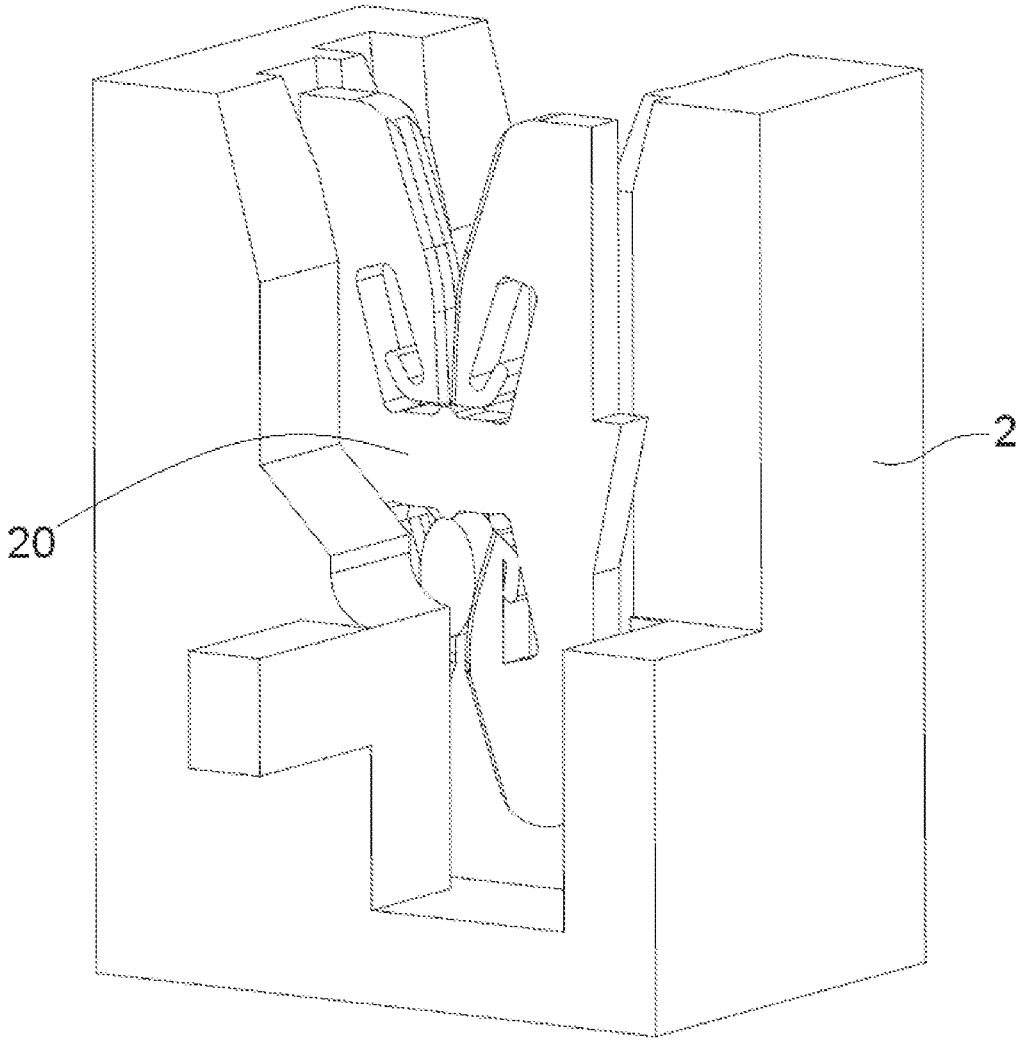
FIG. 4 is a perspective view of a connector according to another embodiment.

A connector according to another embodiment, as shown in FIG. 4, comprises an insulation body 2 and a conductive terminal 20 accommodated within the insulation body 2.

Figure 5:
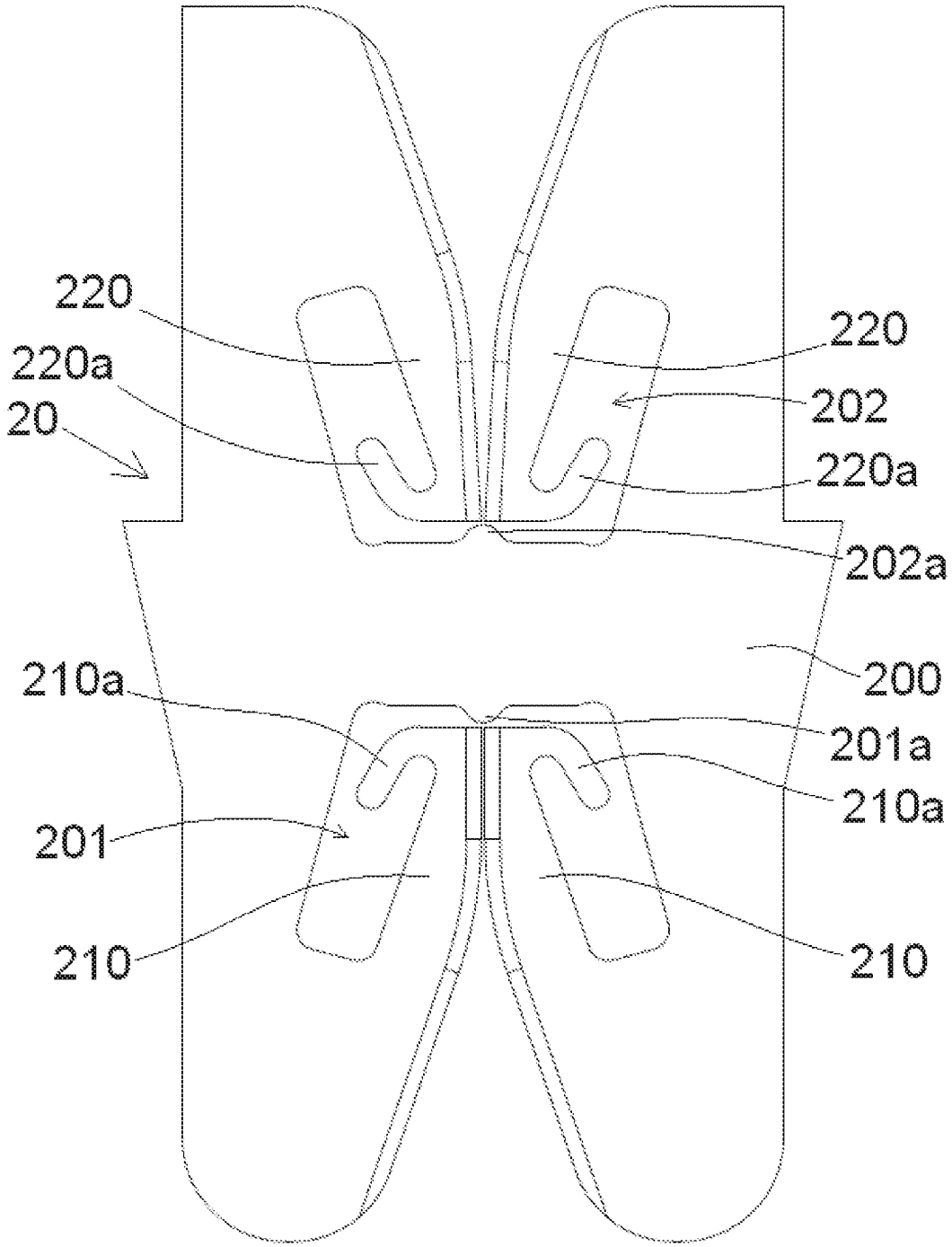
FIG. 5 is a front view of a conductive terminal of the connector of FIG. 4.
Figure 6:
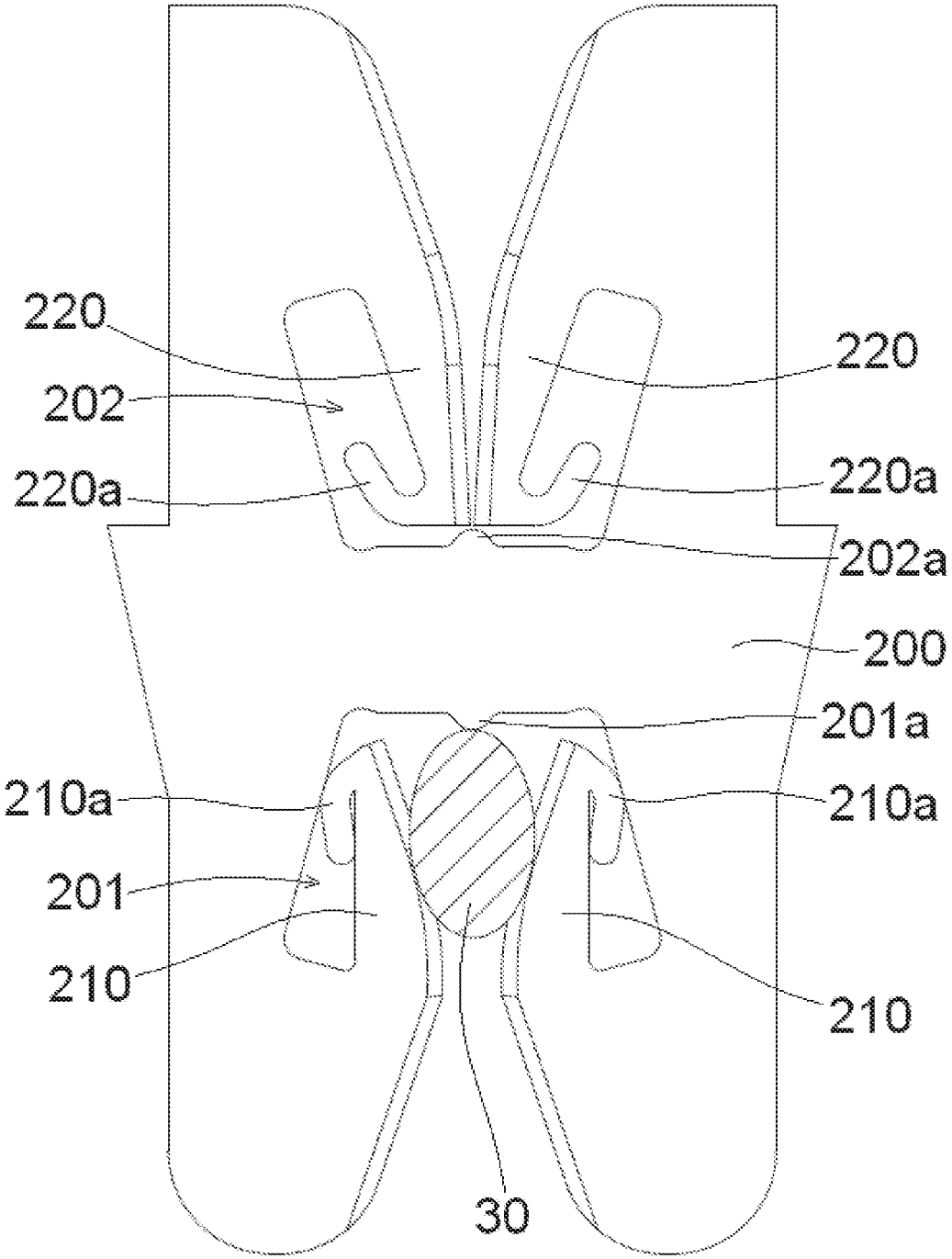
FIG. 6 is a front view of the conductive terminal of FIG. 5 with the first conductor.

As shown in FIGS. 5 and 6, the conductive terminal 20 comprises a body 200 and a pair of first elastic cantilevers 210, 210 adapted to clamp the first conductor 30. The pair of first elastic cantilevers 210, 210 are connected to the body 200 and accommodated within a first accommodation chamber 201 formed in the body 200. In an embodiment, the conductive terminal 20 is a single metal terminal formed by punching a single metal sheet or by a molding process.

As shown in FIGS. 5 and 6, each first elastic cantilever 210 is formed with a first elastic support structure, by which a free end of each first elastic cantilever 210 is elastically supported on an inner wall of the first accommodation chamber 201 when the first conductor 30 is pressed and clamped between the pair of first elastic cantilevers 210, 210. The first elastic support structure includes a first hook portion 210*a* formed at a free end of each first elastic cantilever 210. The free end of each first elastic cantilever 210 is elastically supported on the inner wall of the first accommodation chamber 201 through the first hook portion 210*a* when the first conductor 30 is pressed and clamped between the pair of first elastic cantilevers 210, 210. In this way, each first elastic cantilever 210 may be become a simple supported beam structure from a cantilever beam structure, thereby effectively reducing the risk of plastic deformation of the first elastic cantilevers 210, 210.

As shown in FIGS. 5 and 6, the inner wall of the first accommodation chamber 201 has a first arc protrusion 201*a* facing end surfaces of the free ends of the pair of first elastic cantilevers 210, 210. As shown in FIG. 6, the first conductor 30 abuts against the first arc protrusion 201*a* when the first conductor 30 is pressed and clamped between the pair of first elastic cantilevers 210, 210. Thus, it is possible to protect the first conductor 30 from being scratched and worn by a sharp edge of the inner wall of the first accommodation chamber 201.

The conductive terminal 20, as shown in FIGS. 5 and 6, comprises a pair of second elastic cantilevers 220, 220 adapted to clamp a second conductor. The pair of second elastic cantilevers 220, 220 are connected to the body 200 and accommodated within a second accommodation chamber 202 formed in the body 200. Each second elastic cantilever 220 has a second elastic support structure so that a free end of each second elastic cantilever 220 is elastically supported on an inner wall of the second accommodation chamber 202 by the second elastic support structure when the second conductor is clamped between the pair of second elastic cantilevers 220, 220. In the shown embodiment, the first pair of elastic cantilevers 210, 210 and the pair of second elastic cantilevers 220, 220 are identical to each other and symmetrically arranged on the conductive terminal 20.

The second elastic support structure, as shown in FIGS. 5 and 6, includes a second hook portion 220*a* formed on the free end of each second elastic cantilever 220. The free end of the second elastic cantilever 220 is elastically supported on the inner wall of the second accommodation chamber 202 by the second hook portion 220*a* when the second conductor is clamped between the pair of second elastic cantilevers 220, 220. In this way, each second elastic cantilever 220 becomes a simple supported beam structure from a cantilever beam structure, thereby effectively reducing the risk of plastic deformation of the second elastic cantilevers.

As shown in FIGS. 5 and 6, the inner wall of the second accommodation chamber 202 has a second arc protrusion 202*a* facing end surfaces of the free ends of the pair of second elastic cantilevers 220, 220. The second conductor abuts against the second arc protrusion 202*a* when the second conductor is pressed and clamped between the pair of second elastic cantilevers 220, 220. Thus, it is possible to protect the second conductor from being scratched and worn by a sharp edge of the inner wall of the second accommodation chamber 202.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate embodiments of the disclosure by way of example, and should not be construed as limitation to the disclosure.

Although several exemplary embodiments have been shown and described, it would be appreciated by those skilled in the art that various changes or modifications may be made to these embodiments without departing from the principles and spirit of the disclosure, the scope of which is defined by the claims and their equivalents.

What is claimed is:

1. A conductive terminal, comprising:

a body; and a pair of first elastic cantilevers adapted to clamp a first conductor, the pair of first elastic cantilevers are connected to the body and accommodated within a first accommodation chamber formed in the body, the body has a first elastic support structure, a free end of each first elastic cantilever is elastically supported on an inner wall of the first accommodation chamber by the first elastic support structure when the first conductor is clamped between the pair of first elastic cantilevers, wherein the first elastic support structure includes a first protrusion disposed on the inner wall of the first accommodation chamber and a first aperture formed through and surrounded by the body, and wherein the first aperture is disposed adjacent the first protrusion so that the first protrusion is elastically deformable under compression into the first aperture.

2. The conductive terminal of claim 1, wherein the free end of each first elastic cantilever is elastically supported on the first protrusion when the first conductor is clamped between the pair of first elastic cantilevers.

3. The conductive terminal of claim 2, further comprising a pair of second elastic cantilevers adapted to clamp a second conductor.

4. The conductive terminal of claim 3, wherein the pair of first elastic cantilevers and the pair of second elastic cantilevers are identical to each other and symmetrically arranged on the conductive terminal.

5. The conductive terminal of claim 3, wherein the pair of second elastic cantilevers are connected to the body and accommodated within a second accommodation chamber formed in the body.

6. The conductive terminal of claim 5, wherein the second conductor has a diameter less than a diameter of the first conductor and a free end of each second elastic cantilever is not in contact with an inner wall of the second accommodation chamber when the second conductor is clamped between the pair of second elastic cantilevers.

7. A conductive terminal, comprising:

a body; and a pair of first elastic cantilevers adapted to clamp a first conductor, the pair of first elastic cantilevers are connected to the body and accommodated within a first accommodation chamber formed in the body, each first elastic cantilever or the body has a first elastic support structure, a free end of each first elastic cantilever is elastically supported on an inner wall of the first accommodation chamber by the first elastic support structure when the first conductor is clamped between the pair of first elastic cantilevers, wherein the first elastic support structure includes a first hook portion disposed on the free end of each first elastic cantilever, the first hook portion defining at least one surface which at least partially opposes a surface of the first elastic cantilever and being elastically deformable with respect to a remainder of each respective first elastic cantilever in response to the first conductor being clamped between the pair of first elastic cantilevers.

8. The conductive terminal of claim 7, wherein the inner wall of the first accommodation chamber has a first arc protrusion facing an end surface of the free end of each first elastic cantilever.

9. The conductive terminal of claim 8, further comprising a pair of second elastic cantilevers adapted to clamp a second conductor.

10. The conductive terminal of claim 9, wherein the pair of first elastic cantilevers and the pair of second elastic cantilevers are identical to each other and symmetrically arranged on the conductive terminal.

11. The conductive terminal of claim 9, wherein the pair of second elastic cantilevers are connected to the body and accommodated within a second accommodation chamber formed in the body.

12. The conductive terminal of claim 11, wherein each second elastic cantilever has a second elastic support structure, a free end of each second elastic cantilever is elastically supported on an inner wall of the second accommodation chamber by the second elastic support structure when the second conductor is clamped between the pair of second elastic cantilevers.

13. The conductive terminal of claim 12, wherein the second elastic support structure includes a second hook portion formed on the free end of each second elastic cantilever.

14. The conductive terminal of claim 13, wherein the inner wall of the second accommodation chamber has a second arc protrusion facing an end surface of the free end of each second elastic cantilever.

* * * * *